US011209160B2

(12) United States Patent
Wu

(10) Patent No.: US 11,209,160 B2
(45) **Date of Patent: *Dec. 28, 2021**

(54) COMBUSTION DEVICE HAVING DOUBLE-LAYER STRUCTURE

(71) Applicant: Pro-Iroda Industries, Inc., Taichung (TW)

(72) Inventor: Wei Cheng Wu, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 146 days.

This patent is subject to a terminal disclaimer.

(21) Appl. No.: 16/424,524

(22) Filed: May 29, 2019

(65) Prior Publication Data

US 2020/0271313 A1 Aug. 27, 2020

(30) Foreign Application Priority Data

Feb. 26, 2019 (TW) ..... 108106392

(51) Int. Cl.
*F23D 3/24* (2006.01)
*F23D 3/02* (2006.01)
(Continued)

(52) U.S. Cl.
CPC ..... *F23D 3/24* (2013.01); *F21V 3/02* (2013.01); *F21V 29/15* (2015.01);
(Continued)

(58) Field of Classification Search
CPC .... F23D 3/24; F23D 3/02; F23D 2900/00018; F23D 2700/003; F23D 2700/005;
(Continued)

(56) References Cited

U.S. PATENT DOCUMENTS 12,550 A * 3/1855 Harris ..... F21V 37/00 431/324
13,860 A * 11/1855 Bennett ..... F21V 37/00 431/324
(Continued)

FOREIGN PATENT DOCUMENTS

CA 2422284 A1 9/2004
CN 101119673 A 2/2008
(Continued)

OTHER PUBLICATIONS

"DE_19826856_A1_M—Machine Translation.pdf", Machine Translation, EPO.org, Dec. 18, 2020. (Year: 2020).*
Machine Translation, Included w/DE-3348049-C2. (Year: 2021).*

*Primary Examiner* — Steven B McAllister
*Assistant Examiner* — Daniel E. Namay
(74) *Attorney, Agent, or Firm* — Karin L. Williams; Alan D. Kamrath; Mayer & Williams PC

(57) ABSTRACT

A combustion device having a double-layer structure includes a main body, which is double layered, including an inner-layer wall and an outer-layer wall disposed outside of and spaced from the inner-layer wall such that the inner-layer wall and the outer-layer wall include a hollow disposed therebetween. The inner-layer wall forms a fuel receptacle with an opening. A wick has an end defining fuel-drawing end inserted into the fuel receptacle through the opening.

19 Claims, 6 Drawing Sheets

(51) Int. Cl.

| | |
|---|---|
| ***F21V 29/15*** | (2015.01) |
| ***F21V 3/02*** | (2006.01) |
| ***F21V 37/00*** | (2006.01) |
| *B65D 81/38* | (2006.01) |
| *F21L 19/00* | (2006.01) |
| *F23D 3/18* | (2006.01) |

(52) U.S. Cl.
CPC ..... *F21V 37/0095* (2013.01); *F23D 3/02* (2013.01); *B65D 81/3818* (2013.01); *F21L 19/00* (2013.01); *F21V 37/007* (2013.01); *F21V 37/0008* (2013.01); *F21V 37/0066* (2013.01); *F23D 3/18* (2013.01); *F23D 2900/00018* (2013.01)

(58) Field of Classification Search
CPC . F23D 2700/006; F23D 3/18; B65D 81/3818; F21L 19/00; F24C 5/02; F24C 5/20; F21V 37/0008; F21V 37/0066; F21V 37/007; F21V 37/0095
USPC ..... 431/320, 102, 288, 291; 126/49, 47, 30
See application file for complete search history.

(56) References Cited

U.S. PATENT DOCUMENTS

| | | | | | |
|---|---|---|---|---|---|
| 36,077 | A * | 8/1862 | Davis | F21L 19/00 | 362/180 |
| 63,441 | A * | 4/1867 | Thompson | F21L 19/00 | 362/180 |
| 257,402 | A * | 5/1882 | Staehlen | F16L 39/04 | 137/580 |
| 306,962 | A * | 10/1884 | Saunders | F23N 1/022 | 431/89 |
| 315,875 | A * | 4/1885 | Wlach | F21L 19/00 | 362/180 |
| 545,313 | A * | 8/1895 | Robertson | F23D 91/02 | 431/241 |
| 1,272,995 | A * | 7/1918 | Piotrowski | F24C 5/20 | 126/43 |
| 1,421,209 | A * | 6/1922 | Gehrer | F23D 3/00 | 431/249 |
| 1,650,716 | A * | 11/1927 | Hoffman | F23D 3/00 | 431/309 |
| 2,138,128 | A * | 11/1938 | White | F23D 3/00 | 431/312 |
| 2,627,304 | A * | 2/1953 | Lange | F23D 3/00 | 431/252 |
| 3,473,014 | A * | 10/1969 | Kayne | F21V 35/00 | 362/161 |
| 3,840,327 | A * | 10/1974 | Kayne | F21L 19/00 | 431/125 |
| 4,261,695 | A * | 4/1981 | Reninger | F21S 13/00 | 431/313 |
| 4,693,681 | A | 9/1987 | Comstock | | |
| 5,807,093 | A * | 9/1998 | Tendick, Sr. | F21L 17/00 | 431/146 |
| 5,938,430 | A * | 8/1999 | Majerowski | F24C 5/04 | 431/320 |
| 6,960,320 | B1 * | 11/2005 | Smith | A61L 9/03 | 362/171 |
| 7,950,920 | B2 * | 5/2011 | Vale | F23D 11/36 | 431/88 |
| 8,342,839 | B2 * | 1/2013 | Rindom | F21V 35/00 | 431/289 |
| 9,702,549 | B2 | 7/2017 | White et al. | | |
| 9,797,557 | B2 * | 10/2017 | White | F21L 27/00 | |
| 10,253,975 | B2 * | 4/2019 | White | F24C 3/022 | |
| 2003/0036030 | A1 * | 2/2003 | Doppelt | F23D 3/30 | 431/316 |
| 2003/0202343 | A1 * | 10/2003 | Winkler | B44C 5/04 | 362/171 |
| 2005/0232808 | A1 * | 10/2005 | Smith | A61L 9/03 | 422/5 |
| 2009/0136881 | A1 * | 5/2009 | Vale | F23D 11/36 | 431/12 |
| 2010/0215549 | A1 * | 8/2010 | Corda | F23D 3/18 | 422/122 |
| 2011/0053104 | A1 * | 3/2011 | Rindom | F21V 35/00 | 431/289 |
| 2011/0198550 | A1 * | 8/2011 | Howard | F21S 13/10 | 256/59 |
| 2011/0311925 | A1 * | 12/2011 | Chen | F21S 13/12 | 431/291 |
| 2013/0027918 | A1 * | 1/2013 | White | F21S 9/037 | 362/157 |
| 2013/0288189 | A1 * | 10/2013 | White | F23D 3/04 | 431/310 |
| 2014/0227650 | A1 | 8/2014 | Wrobel | | |
| 2017/0268770 | A1 * | 9/2017 | White | F24C 3/022 | |
| 2019/0101281 | A1 | 4/2019 | Chen | | |
| 2020/0370746 | A1 * | 11/2020 | Wu | F23D 3/18 | |
| 2020/0400307 | A1 * | 12/2020 | Wu | F23D 3/40 | |

FOREIGN PATENT DOCUMENTS

| | | | | |
|---|---|---|---|---|
| CN | 203162941 | U | 8/2013 | |
| DE | 3348049 | C2 * | 3/1988 | F21S 13/00 |
| DE | 4314122 | A1 | 11/1994 | |
| DE | 19542631 | A1 * | 5/1997 | F21V 37/00 |
| DE | 19826856 | A1 * | 7/1999 | F21V 37/00 |
| EP | 1760396 | A1 | 3/2007 | |
| JP | S24012830 | Y | 12/1949 | |
| JP | S59161201 | U | 10/1984 | |
| JP | 3149849 | U | 4/2009 | |
| TW | M532872 | U | 12/2016 | |

* cited by examiner

COMBUSTION DEVICE HAVING DOUBLE-LAYER STRUCTURE

BACKGROUND OF THE INVENTION

1. Field of the Invention

The present invention relates to a combustion device and, particularly, to a combustion device having a double-layer structure.

2. Description of the Related Art

TW patent No. 1625493 shows a flame-display combination structure including an accommodation device, a burning device, and a fixing device. The accommodation device includes a fuel container, a top a cover, and a heat insulating member. The fuel container defines a receiving portion disposed therein and connected to the top cover. The top cover includes a filler hole and a first positioning groove extending therethrough and communicating with the receiving portion. The heat insulating member is connected to an end of the top cover different from that to which the receiving portion is connected. The heat insulating member includes a second positioning groove extending through the top side and the bottom side thereof and communicating with the first positioning groove. The burning device includes a second end inserted into the receiving portion through the second positioning groove and the first positioning groove. The burning device is sandwiched between a first clamping surface and a second clamping surface of the fixing device.

Since the temperatures of the upper of the fuel container and a shielding member disposed adjacent to the upper of the fuel container are high and higher than other regions of the combination structure, heat is conducted downwards, and the fuel container can thus become hot and unsafe to hold after using the combination structure for a long period.

The present invention is, therefore, intended to obviate or at least alleviate the problems encountered in the prior art.

SUMMARY OF THE INVENTION

According to the present invention, a combustion device having a double-layer structure includes a main body which is double layered. The main body includes an inner-layer wall and an outer-layer wall disposed outside of and spaced from the inner-layer wall such that the inner-layer wall and the outer-layer wall include a hollow disposed therebetween. The inner-layer wall forms a fuel receptacle with an opening. A wick has an end defining fuel-drawing end inserted into the fuel receptacle through the opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
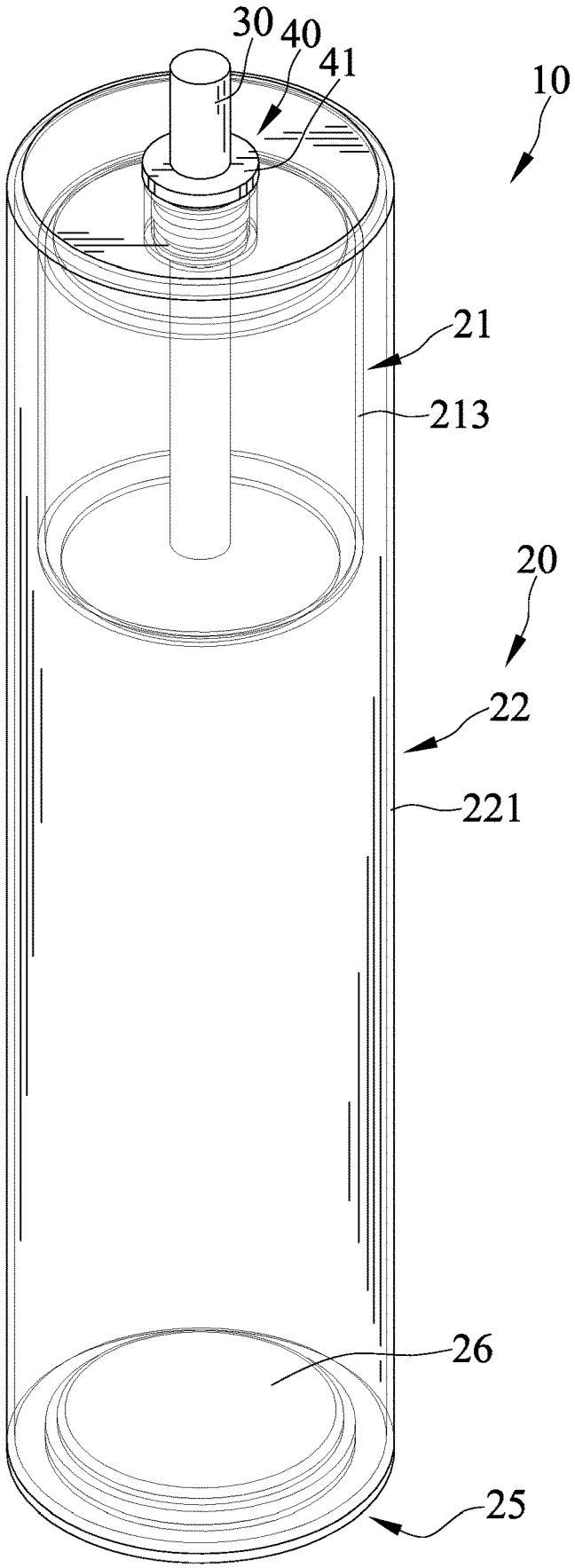
FIG. 1 is a perspective view of a combustion device having a double-layer structure in accordance with a first embodiment of the present invention.
Figure 2:
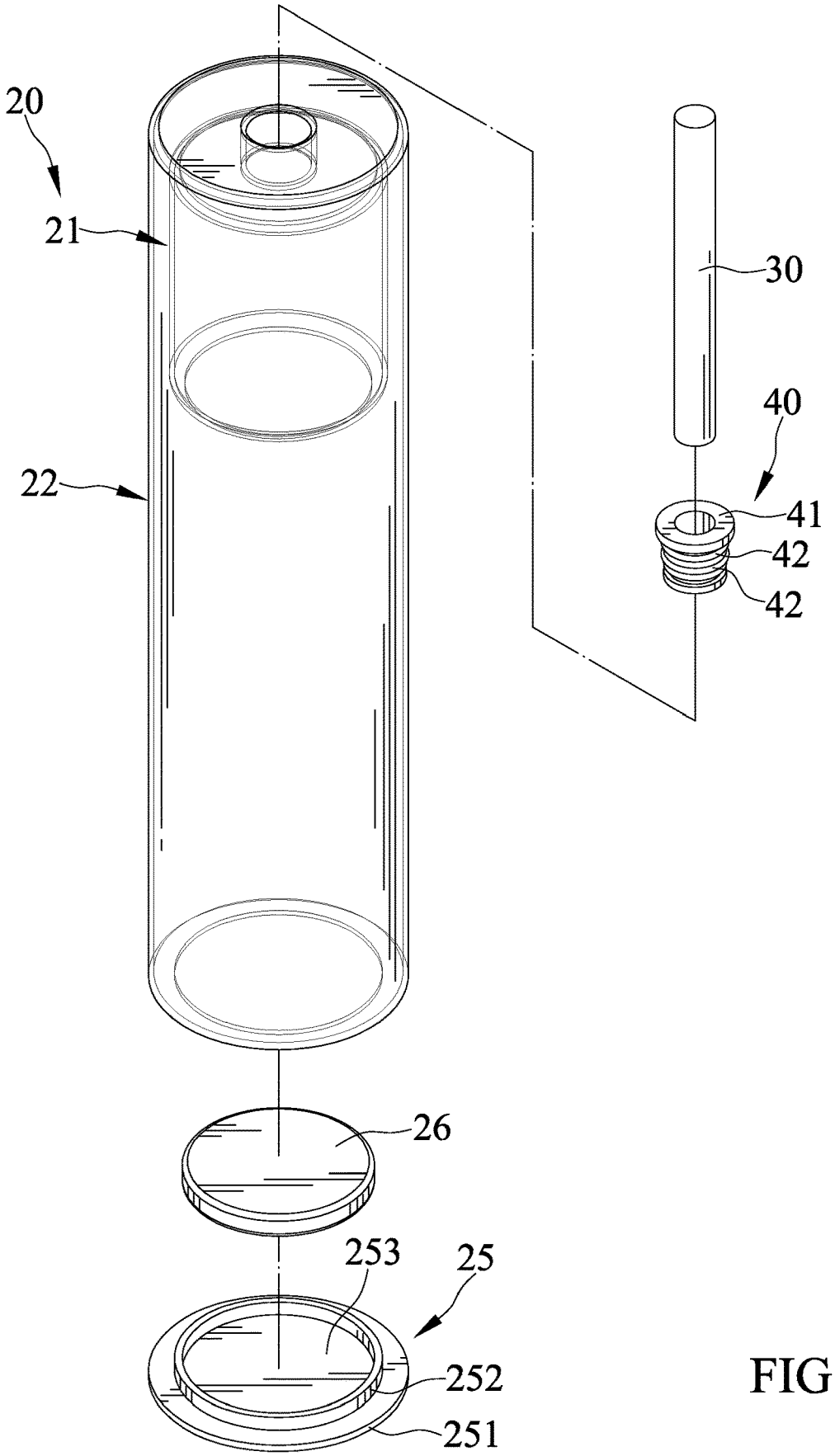
FIG. 2 is an exploded perspective view of the combustion device having a double-layer structure of FIG. 1.
Figure 3:
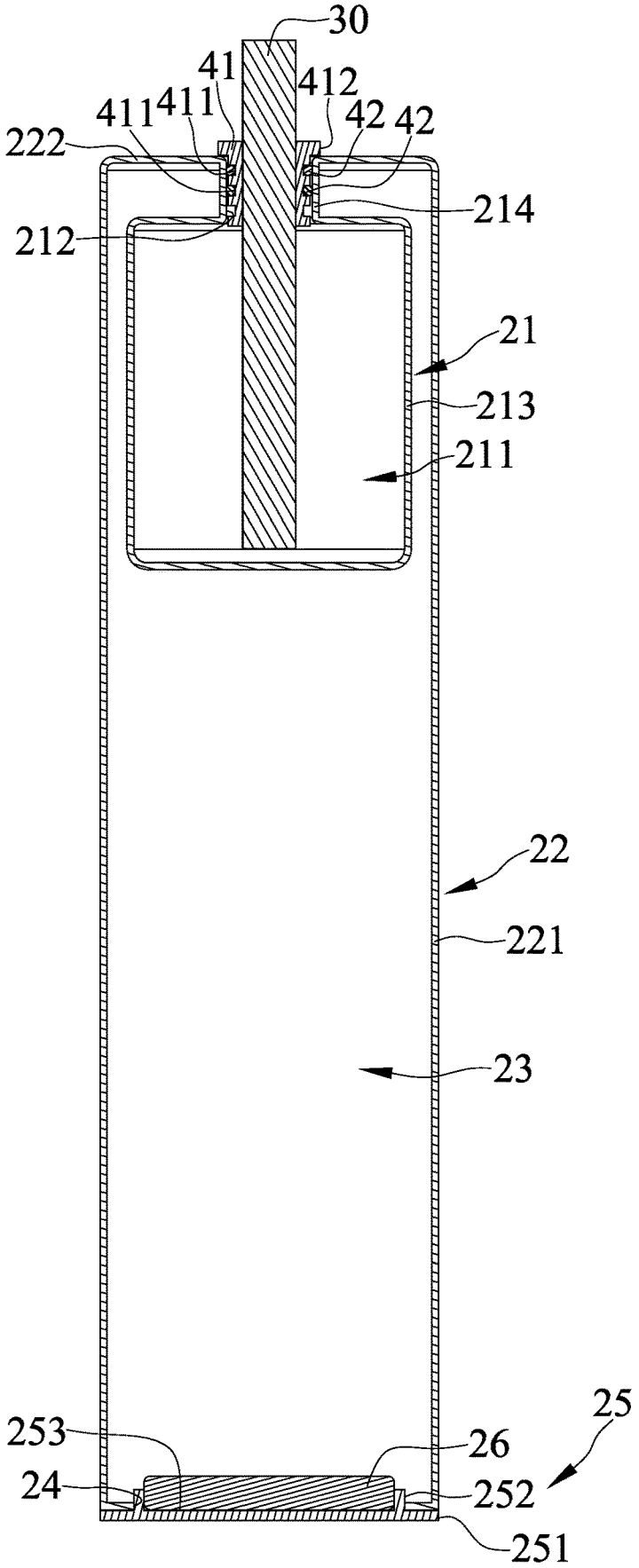
FIG. 3 is a cross-sectional view of the combustion device having a double-layer structure of FIG. 1.

FIGS. 1 through 3 show a combustion device 10 having a double-layer structure in accordance with a first embodiment of the present invention.

The combustion device 10 includes a main body 20 which is double layered. The main body 20 is one-piece.

The main body 20 includes an inner-layer wall 21 and an outer-layer wall 22 disposed outside of and spaced from the inner-layer wall 21 such that the inner-layer wall 21 and the outer-layer wall 22 include a hollow 23 disposed therebetween.

The inner-layer wall 21 and the outer-layer wall 22 are made from a transparent material.

The inner-layer wall 21 is in a form of a cylinder. The outer-layer wall 22 is in a form of a cylinder which has a radius greater than a radius of the inner-layer wall 21. The outer-layer wall 22 has a center disposed coaxially with a center of the inner-layer wall 21. The outer-layer wall 22 has a portion defining connecting portion 222 which extends radially from the interconnecting portion 214 to a circumference 221 of the outer-layer wall 22.

The inner-layer wall 21 forms a fuel receptacle 211*a* with an opening 212. Fuel can be poured into the fuel receptacle 211 through the opening 212. In this regard, the main body 20 has a receiving portion 213 formed by the inner-layer wall 21 and the receiving portion 213 forms the fuel receptacle 211.

The main body 20 has an interconnecting portion 214 interconnecting the inner-layer wall 21 and the outer-layer wall 22. The interconnecting portion 214 extends from an outer periphery of the inner-layer wall 21 to an inner periphery of the outer-layer wall 22. The interconnecting portion 214 is hollow.

The outer-layer wall 22 is disposed on a pedestal 25. The pedestal 25 is fit in a through hole 24 which extends through the outer-layer wall 22 and is in communication with the hollow 23. The pedestal 25 has a flat bottom side that allows the combustion device 10 to be disposed on a surface stably. The pedestal 25 has a wide section 251 disposed outside of the through hole 24 and a narrow section 252 fit in place in the through hole 24. The flat bottom side of the pedestal 25 is formed on the bottom side of the wide section 251.

The pedestal 25 defines a space 253 in which a ballast 26 is disposed. The space 253 is defined by the narrow section 252 of the pedestal 25. The ballast 26 protrudes into the hollow 23

A wick 30 has an end defining fuel-drawing end inserted into the fuel receptacle 211*a* through the opening 212. The wick 30 is inserted through the interconnecting portion 214. The wick 30 has an end defining burning end disposed outside of the interconnecting portion 214 and the outer-layer wall 22. The wick 30 is metallic.

A retaining device 40 securely holding the wick 30 in an upright position fit in place in the opening 212. The retaining device 40 is also fit in place in the interconnecting portion 214. The wick 30 is held by a sleeve 41 of the retaining device 40. The sleeve 41 is fit in the interconnecting portion 214 and has a flange 412 that rests on the connecting portion 222 of the outer-layer wall 22. The sleeve 41 has an outer periphery with at least one groove 411 extending thereon and at least one gasket 42 is mounted in the at least one groove 411. The at least one gasket 42 abuts a periphery of the interconnecting portion 214.

Figure 4:
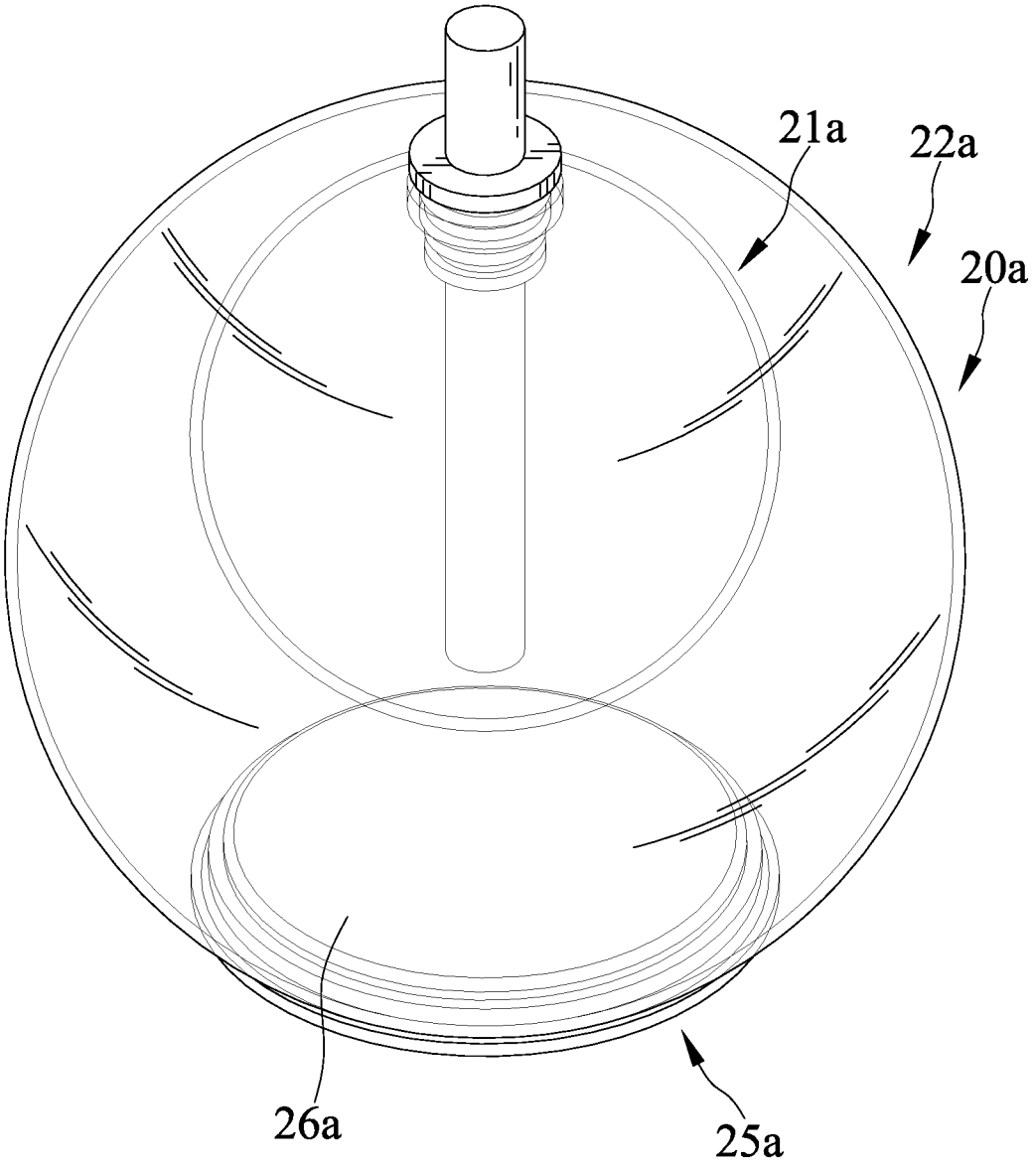
FIG. 4 is a perspective view of a combustion device having a double-layer structure in accordance with a second embodiment of the present invention.
Figure 5:
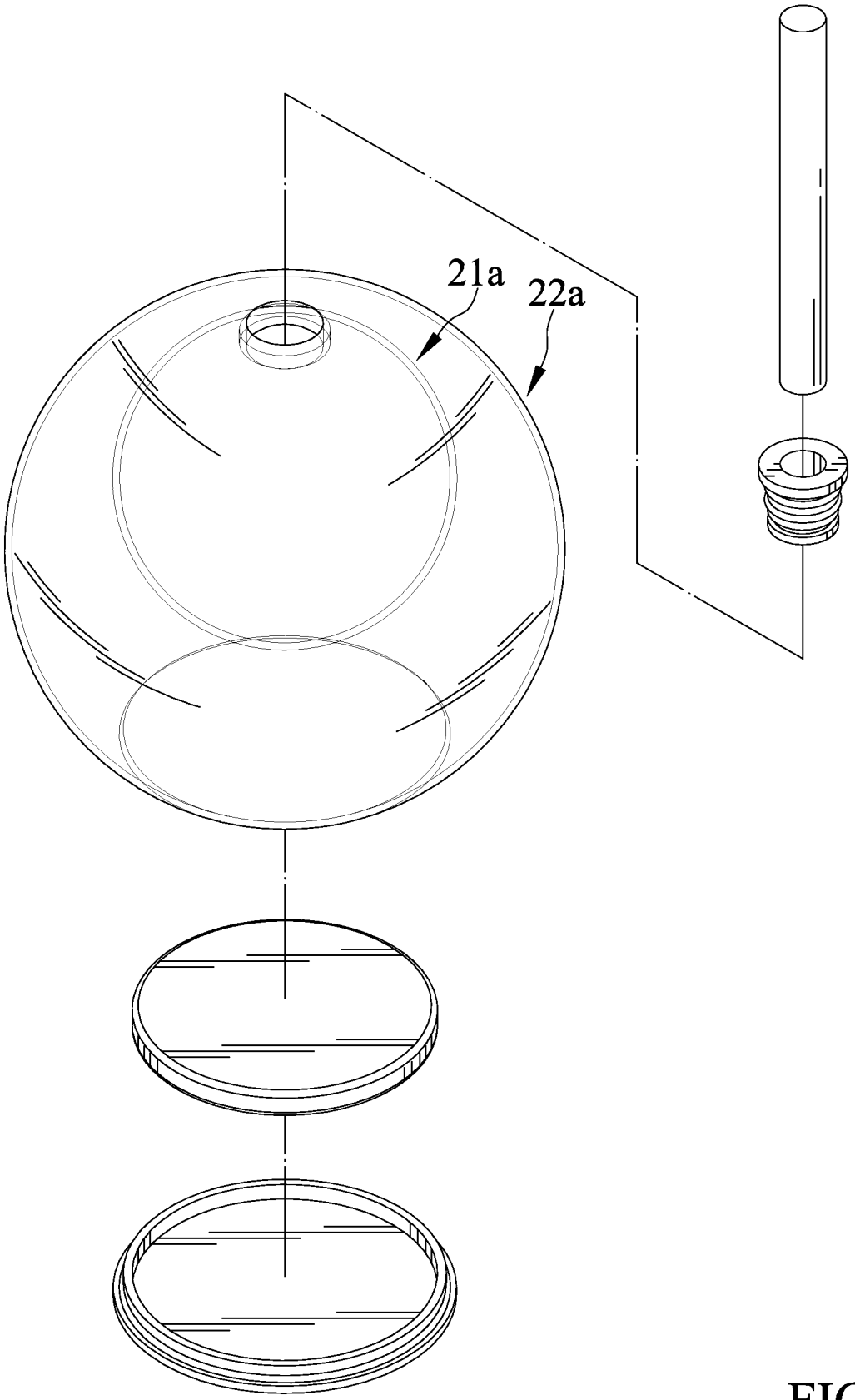
FIG. 5 is an exploded perspective view of the combustion device having a double-layer structure of FIG. 4.
Figure 6:
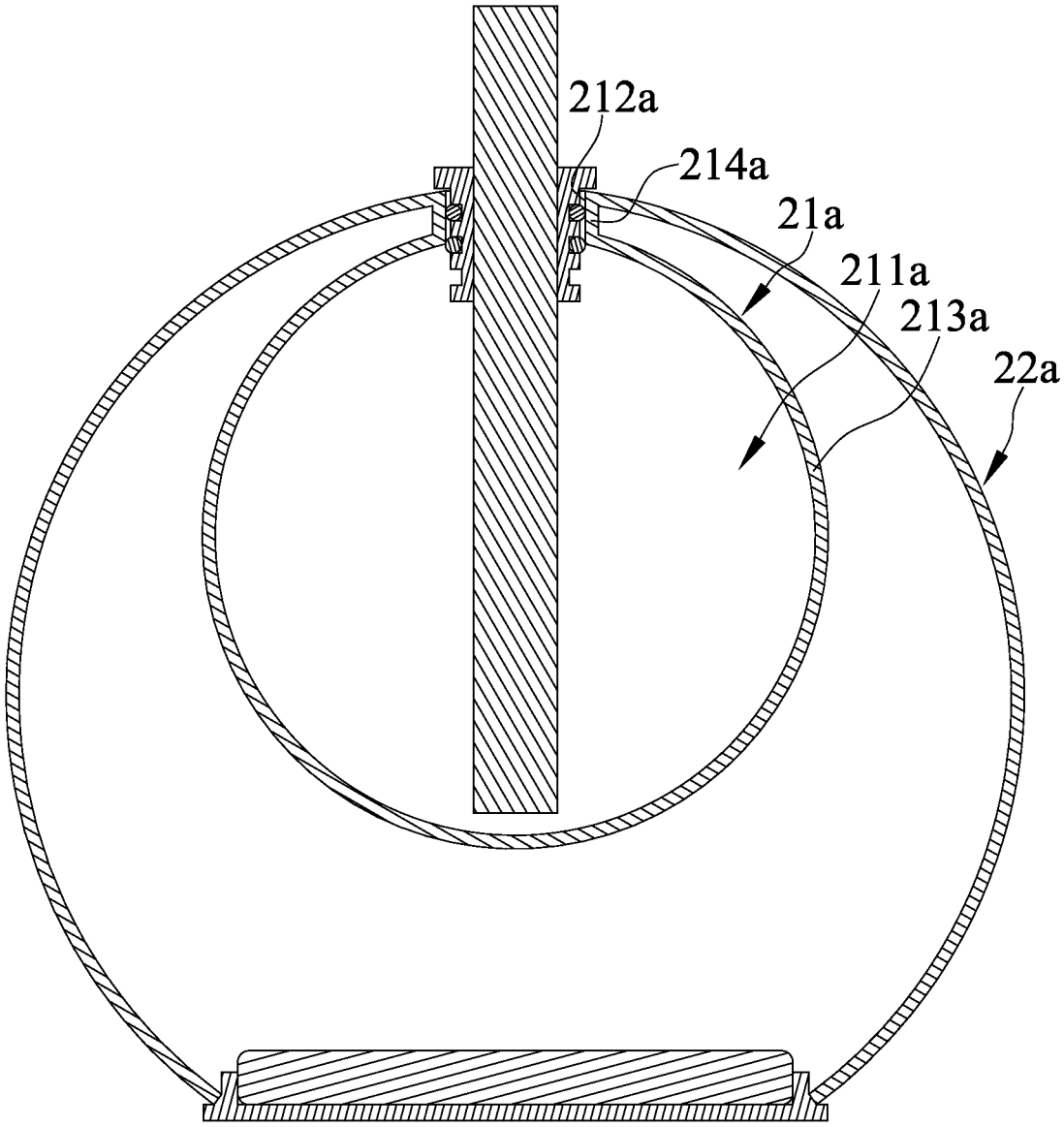
FIG. 6 is a cross-sectional view of the combustion device having a double-layer structure of FIG. 4.

FIGS. 4 through 6 show a combustion device having a double-layer structure in accordance with a second embodiment of the present invention, and the same numbers are used to correlate similar components of the first embodiment, but bearing a letter a. Similarly, the combustion device has a double layered main body 20*a*. The main body 20*a* includes an inner-layer wall 21*a* and an outer-layer wall 22*a* disposed outside of and spaced from the inner-layer wall 21*a* such that the inner-layer wall 21*a* and the outer-layer wall 22*a* include a hollow disposed therebetween. The inner-layer wall 21 forms a fuel receptacle 211*a* with an opening 212*a*. The main body 20 has a receiving portion 213*a* formed by the inner-layer wall 21*a*. The main body 20*a* has an interconnecting portion 214*a* interconnecting the inner-layer wall 21*a* and the outer-layer wall 22*a*. The interconnecting portion 214*a*) extends from an outer periphery of the inner-layer wall 21*a* to an inner periphery of the outer-layer wall 22*a*. The interconnecting portion 214*a* is hollow and the wick is inserted through the interconnecting portion 214*a*. The wick 30 has an end defining burning end disposed outside of the interconnecting portion 214*a* and the outer-layer wall 22*a*. The outer-layer wall 22*a* is disposed on a pedestal 25*a*. The pedestal 25*a* defines a space in which a ballast 26*a* is disposed The second embodiment differentiates from the first embodiment in that the main body 20*a* has a shape different from that of the main body 20. The inner-layer wall 21*a* is in a form of a sphere. The outer-layer wall 22*a* is in a form of a sphere which has a radius greater than a radius of the inner-layer wall 21*a*. The inner-layer wall 21 and the outer-layer wall 22 are disposed eccentrically.

In view of the foregoing, heat emitted from the wick 30 is effectively insulated to the outer-layer walls 22 and 22*a*, so that the outer-layer walls 22 and 22*a* will not become hot. Further, an air gap between the inner-layer walls 21 and 21*a* and the outer-layer walls 22 and 22*a* effectively insulate fuel in fuel receptacles 211 and 211*a* from being vaporized by heat.

The foregoing is merely illustrative of the principles of this invention and various modifications can be made by those skilled in the art without departing from the scope and spirit of the invention.

What is claimed is:

1. A combustion device having a double-layer structure comprising:
   - a main body, which is double layered, including an inner-layer wall and an outer-layer wall disposed outside of and spaced from the inner-layer wall such that the inner-layer wall and the outer-layer wall include a hollow disposed therebetween, and wherein the inner-layer wall forms a fuel receptacle with an opening; and
   - a wick having an end defining fuel-drawing end inserted into the fuel receptacle through the opening;
   - a retaining device including a sleeve securely holding the wick;
   - wherein an air gap between the inner-layer wall and the outer-layer wall effectively insulates fuel in the fuel receptacle from being vaporized by heat;
   - wherein the main body has an interconnecting portion interconnecting the inner-layer wall and the outer-layer wall, wherein the sleeve is fit in the interconnecting portion, and wherein the sleeve has a flange not abutting against a periphery of the interconnecting portion and rested on the outer-layer wall.

2. The combustion device as claimed in claim 1, wherein the main body is one-piece.

3. The combustion device as claimed in claim 1, wherein the interconnecting portion extends from an outer periphery of the inner-layer wall to an inner periphery of the outer-layer wall, wherein the interconnecting portion is hollow and the wick is inserted through the interconnecting portion, and wherein the wick has an end defining a burning end disposed outside of the interconnecting portion and the outer-layer wall.

4. The combustion device as claimed in claim 3, wherein the retaining device securely holds the wick in an upright position fit in place in the opening.

5. The combustion device as claimed in claim 4, wherein the sleeve has an outer periphery with at least one groove extending thereon and at least one gasket is mounted in the at least one groove, and wherein the at least one gasket abuts a periphery of the interconnecting portion.

6. The combustion device as claimed in claim 5, wherein the inner-layer wall and the outer-layer wall are made from a transparent material.

7. The combustion device as claimed in claim 5, wherein the wick is metallic.

8. The combustion device as claimed in claim 1, wherein the retaining device securely holds the wick in an upright position fit in place in the opening.

9. The combustion device as claimed in claim 1, wherein the inner-layer wall is in a form of a cylinder, wherein the outer-layer wall is in a form of a cylinder which has a radius greater than a radius of the inner-layer wall, and wherein the outer-layer wall has a center disposed coaxially with a center of the inner-layer wall.

10. The combustion device as claimed in claim 9, wherein the outer-layer wall has a portion defining a connecting portion which extends radially outwardly from the interconnecting portion to a circumference of the outer-layer wall.

11. The combustion device as claimed in claim 1, wherein the inner-layer wall is in a form of a sphere, wherein the outer-layer wall is in a form of a sphere which has a radius greater than a radius of the inner-layer wall, and wherein the inner-layer wall and the outer-layer wall are disposed eccentrically.

12. The combustion device as claimed in claim 1, wherein the outer-layer wall is disposed on a pedestal, and wherein the pedestal is fit in a through hole which extends through the outer-layer wall and is in communication with the hollow.

13. The combustion device as claimed in claim 12, wherein the pedestal has a wide section disposed outside of the through hole and a narrow section fit in place in the through hole.

14. The combustion device as claimed in claim 12, wherein the pedestal defines a space in which a ballast is disposed.

15. The combustion device as claimed in claim 14, wherein the ballast protrudes into the hollow.

16. The combustion device as claimed in claim 15, wherein the inner-layer wall and the outer-layer wall are made from a transparent material.

17. The combustion device as claimed in claim 15, wherein the wick is metallic.

18. The combustion device as claimed in claim 1, wherein the inner-layer wall and the outer-layer wall are made from a transparent material.

19. The combustion device as claimed in claim 1, wherein the wick is metallic.

* * * * *